US009290909B2

(12) United States Patent
Brenny

(10) Patent No.: US 9,290,909 B2
(45) **Date of Patent: *Mar. 22, 2016**

(54) HOIST ROPE GUIDE

(71) Applicant: Harnischfeger Technologies, Inc., Wilmington, DE (US)

(72) Inventor: Joe Brenny, Hartland, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/515,973

(22) Filed: Oct. 16, 2014

(65) Prior Publication Data

US 2015/0034892 A1 Feb. 5, 2015

Related U.S. Application Data

(63) Continuation of application No. 13/755,258, filed on Jan. 31, 2013, now Pat. No. 8,887,415.

(60) Provisional application No. 61/593,120, filed on Jan. 31, 2012.

(51) Int. Cl.

| | |
|---|---|
| ***E02F 3/58*** | (2006.01) |
| ***E02F 9/14*** | (2006.01) |
| ***E02F 3/36*** | (2006.01) |
| ***E02F 9/20*** | (2006.01) |

(52) U.S. Cl.

CPC ... *E02F 9/14* (2013.01); *E02F 3/36* (2013.01); *E02F 3/58* (2013.01); *E02F 9/2016* (2013.01)

(58) Field of Classification Search

CPC ..... E02F 3/30; E02F 3/304; E02F 3/36; E02F 3/58; E02F 9/006; E02F 9/14; E02F 9/2016; E02F 9/24

USPC ..... 37/394–401; 56/13.2, 13.3; 254/393–399; 474/133, 135

See application file for complete search history.

(56) References Cited

U.S. PATENT DOCUMENTS

| | | | |
|---|---|---|---|
| 1,351,867 | A | 9/1920 | Oakes |
| 3,210,994 | A | 10/1965 | Saxl |
| 3,618,379 | A | 11/1971 | Lipton |
| 3,800,612 | A | 4/1974 | Fulghum |
| 4,171,640 | A | 10/1979 | van Mastrigt |
| 4,760,992 | A | 8/1988 | Peppel et al. |
| 4,917,654 | A | 4/1990 | Edwards |

(Continued)

FOREIGN PATENT DOCUMENTS

| | | |
|---|---|---|
| CN | 201495038 | 6/2010 |
| JP | 07-041289 | 10/1995 |

(Continued)

OTHER PUBLICATIONS

First Office Action from the Australian Patent Office for Application No. 2013200543 dated Apr. 11, 2014 (3 pages).

*Primary Examiner* — Robert Pezzuto

(74) *Attorney, Agent, or Firm* — Michael Best & Friedrich LLP

(57) ABSTRACT

A rope guide that includes an arm, a rope-contacting element, and a spring damper. The rope guide is pivotably coupled to the boom of a mining shovel. The combination of the arm, spring damper, and rope-contacting element maintains a nominal tension in the rope, thereby reducing the likelihood of wear and fatigue on the rope.

21 Claims, 8 Drawing Sheets

(56) References Cited

U.S. PATENT DOCUMENTS

| | | | |
|---|---|---|---|
| 5,560,188 | A | 10/1996 | Murakawa et al. |
| 6,044,991 | A | 4/2000 | Freudenthal et al. |
| 6,067,735 | A | 5/2000 | Kallenberger |
| 6,082,710 | A | 7/2000 | Dragsund et al. |
| 6,401,370 | B1 | 6/2002 | Blom et al. |
| 7,024,806 | B2 | 4/2006 | Suzik et al. |
| 7,415,783 | B2 | 8/2008 | Huffman et al. |
| 2007/0266601 | A1 | 11/2007 | Claxton |

FOREIGN PATENT DOCUMENTS

| | | |
|---|---|---|
| JP | 2001-39678 | 2/2001 |
| SU | 463618 | 3/1975 |
| SU | 1594061 | 9/1990 |

HOIST ROPE GUIDE

CROSS-REFERENCE TO RELATED APPLICATIONS

This application is a continuation of U.S. application Ser. No. 13/755,258, filed on Jan. 31, 2013, which claims priority to U.S. Provisional Application No. 61/593,120, filed on Jan. 31, 2012, each of which is incorporated herein by reference in its entirety.

BACKGROUND

The present invention relates to the field of mining shovels. Specifically, the present invention relates to a guide mechanism for a dipper hoist rope.

Conventional electric rope mining shovels include a boom, a handle having one end coupled to the boom, and the other end coupled to a dipper. The dipper is supported by hoist ropes that pass over a sheave coupled to the end of the boom. The hoist ropes are secured to a winch for paying out and reeling in the ropes. During a digging cycle, the dipper is raised and lowered by reeling in and paying out the hoist rope As the dipper is hoisted through a bank of material, tension in the ropes increases. It is often difficult to directly measure the amount of tension in the ropes, making it difficult for the operator to know whether the ropes are slack or under stress. When the hoist ropes become slack, the ropes oscillate and wear against the rope guide members and the boom, thereby reducing the life of the ropes.

SUMMARY

In one embodiment, the invention provides a rope guide for a mining shovel, the mining shovel including a boom and a rope, the boom including a first end and a second end, the rope passing between first end and the second end of the boom. The rope guide includes an arm pivotably coupled to the boom. The rope guide further includes a first rope-contacting element coupled to the arm, the first rope-contacting element engaging a first portion of the rope, and a second rope-contacting element coupled to the arm, the second rope-contacting element engaging a second portion of the rope and being spaced a distance from the first rope-contacting element. The rope guide also includes a spring damper coupled between the boom and the arm, the spring damper biasing the arm to rotate in a first direction about the first end, the spring damper generating a biasing force that causes the first rope-contacting element and the second rope-contacting element to maintain positive engagement with the rope.

In another embodiment, the invention provides a rope guide for a mining shovel, the mining shovel including a boom and a rope, the boom including a first end and a second end, the rope passing between first end and the second end of the boom. The rope guide includes an arm pivotably coupled to the boom. The rope guide further includes a rope-contacting element coupled to the arm and a spring damper coupled between the boom and the arm. The spring damper biases the arm in a first direction to maintain positive engagement between the rope-contacting element and the rope.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
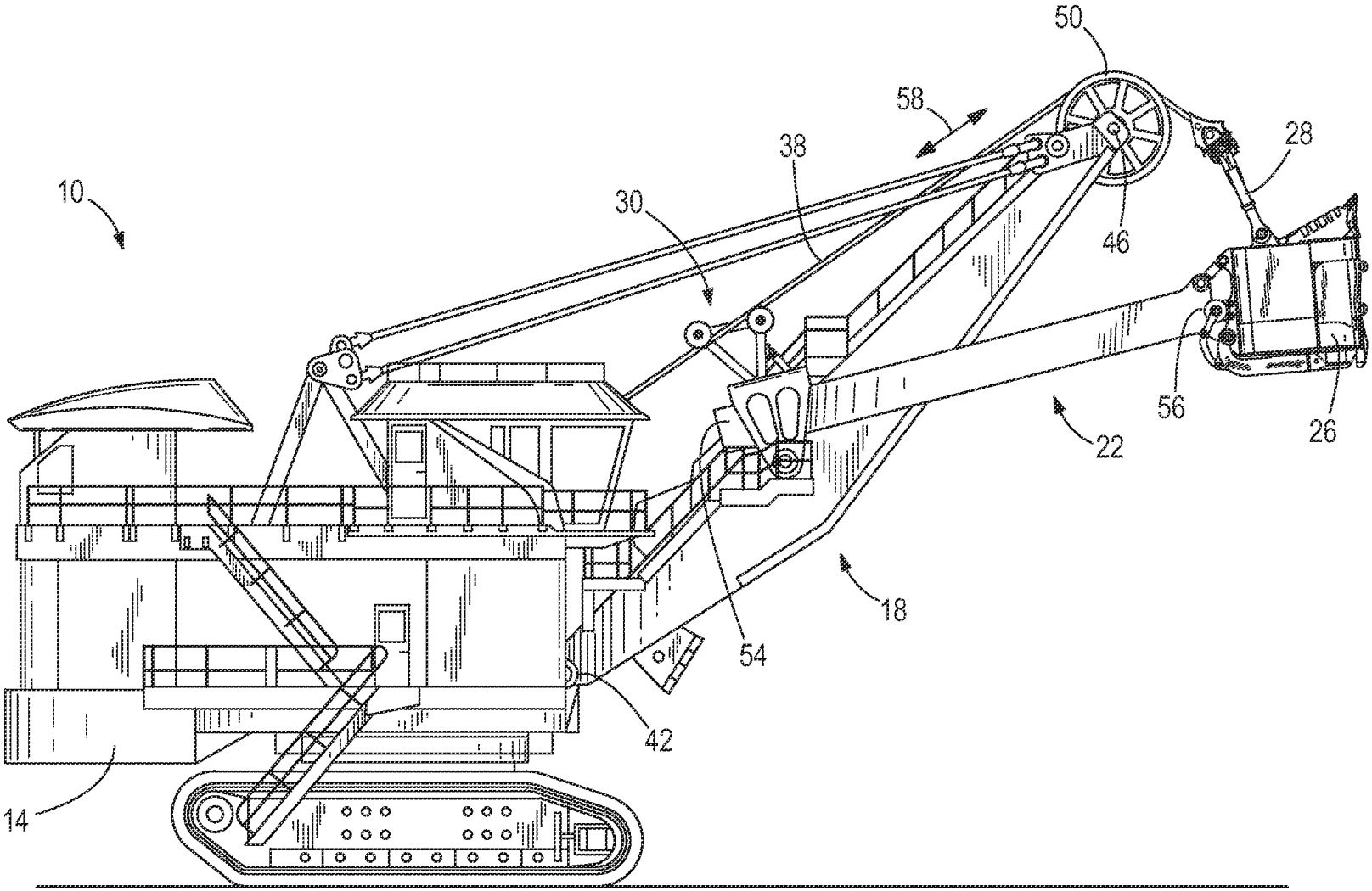
FIG. 1 is a side view of a mining shovel.

As shown in FIG. 1, a mining shovel 10 includes a base 14, a boom 18, a handle 22, a dipper 26, a bail 28, and a rope guide 30. The base 14 includes a winch (such as winch 51 illustrated schematically in the embodiment of FIG. 7) for reeling in and paying out a hoist cable, or rope 38. The boom 18 includes a first end 42 coupled to the base 14, a second end 46 opposite the first end 42, and a boom sheave 50. The boom sheave 50 is coupled to the second end 46 of the boom 18 and guides the rope 38 over the second end 46. The handle 22 includes a first end 54 and a second end 56. The first end 54 of the handle 22 is moveably coupled to the boom 18 at a position between the first end 42 and the second end 46 of the boom 18. The second end 56 of the handle 22 is pivotably coupled to the dipper 26. The rope 38 passing over the boom sheave 50 is coupled to and supports the dipper 26. As the rope 38 is reeled in by the winch, the dipper 26 is raised; as the rope 38 is paid out, the dipper 26 is lowered. The rope 38 passing between the winch and the boom sheave 50 defines a direction of travel 58, and the rope 38 in this portion passes through the rope guide 30.

Figure 2:
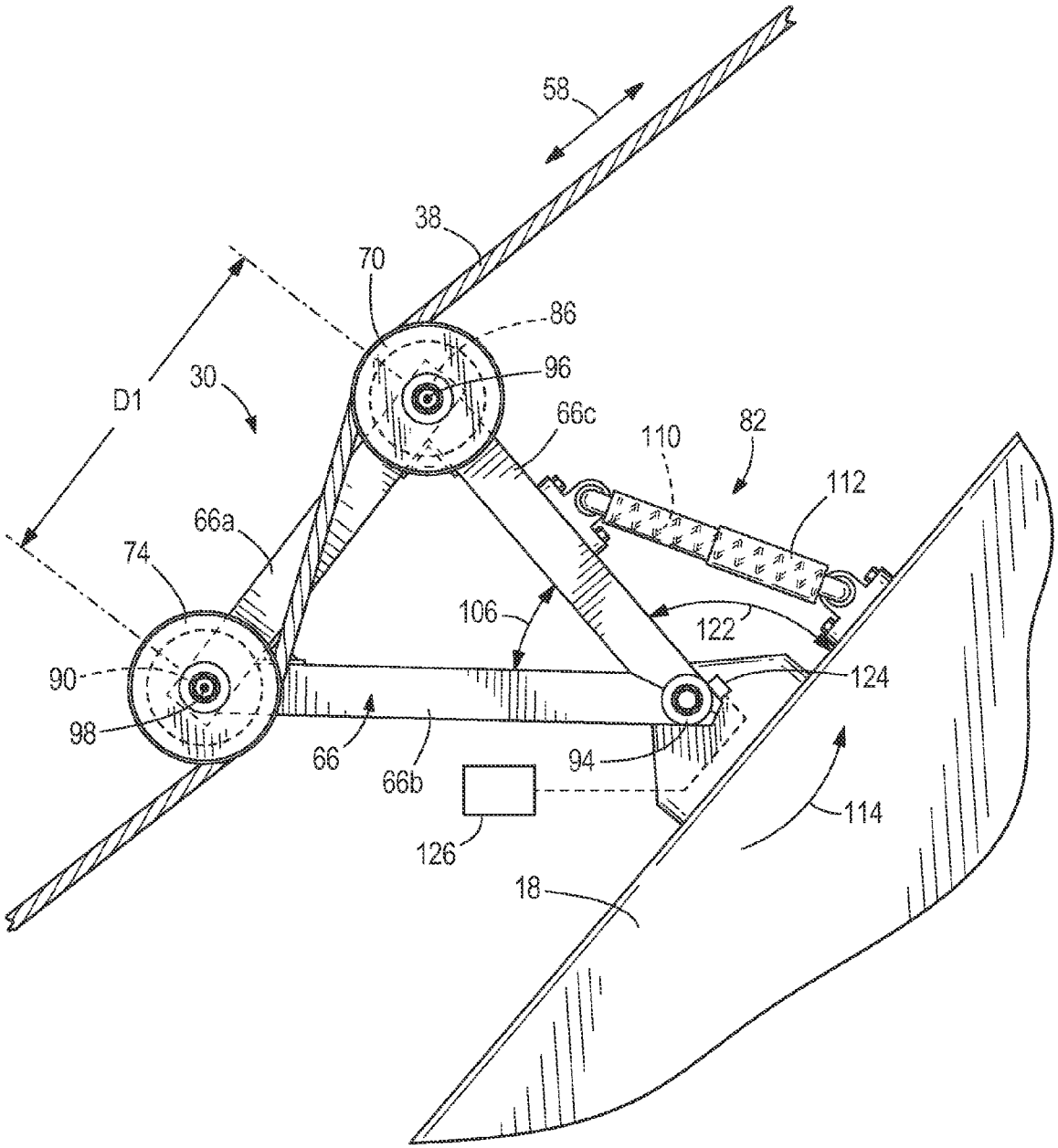
FIG. 2 is a side view of a rope guide according to one embodiment of the invention, with the hoist rope in a slack state.
Figure 3:
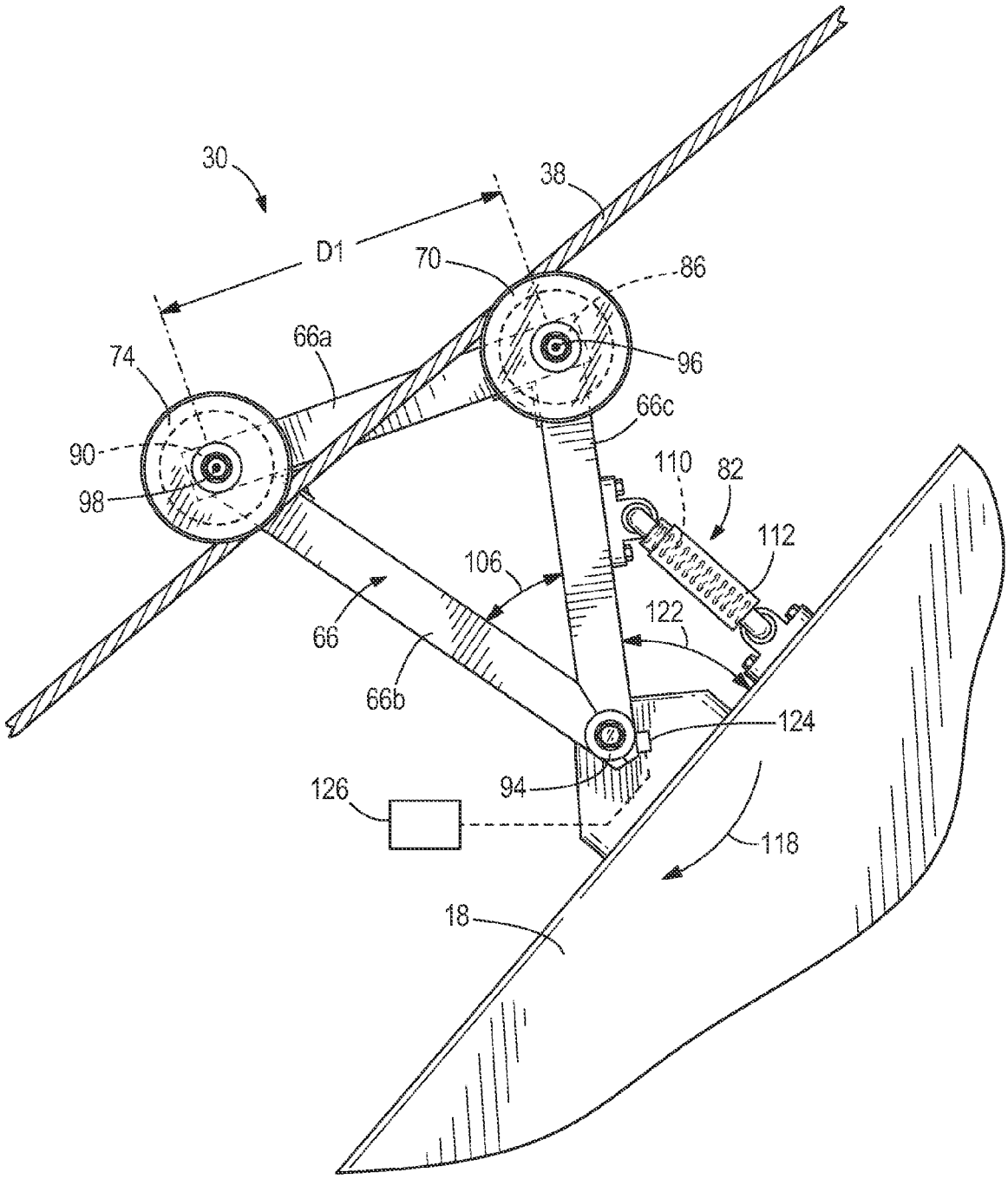
FIG. 3 is a side view of the rope guide of FIG. 2 with the hoist rope in a taut state.

As shown in FIGS. 2 and 3, the rope guide 30 includes an arm 66, a first rope-contacting element 70, a second rope-contacting element 74, and a spring damper 82. In the illustrated embodiment, the arm 66 has a triangular shape formed by three members 66*a*, 66*b*, 66*c* and includes a first end 86, a second end 90, and a third end 94. The third end 94 of the arm 66 is pivotably coupled to the boom 18. In other embodiments, the arm 66 includes fewer or more members, such as two members coupled together at one end spaced apart by a fixed angle at opposite ends.

In the illustrated embodiment, the first rope-contacting element 70 and the second rope-contacting element 74 are sheaves. The first sheave 70 is pivotably coupled to the first end 86 of the arm 66 at a pivot point 96, and the second sheave 74 is pivotably coupled to the second end 90 at a pivot point 98. The first sheave 70 and the second sheave 74 are spaced apart by a distance D1 (as measured between the pivot points 96, 98) such that the rope 38 passes over the first sheave 70 and under the second sheave 74. In the illustrated embodiment, the distance D1 is a fixed distance of approximately 48 inches; however, in further embodiments the distance may be between approximately 36 inches and 72 inches.

In the illustrated embodiment, the first sheave 70 is offset from the second sheave 74 by an angle 106 as measured from the point about which the arm 66 rotates (i.e., the third end 94) between arm members 66*b* and 66*c*. The angle 106 is dependent on the distance D1, and is approximately 40 degrees; however, in further embodiments the angle may be between approximately 30 degrees and 60 degrees. When the rope 38 is taut (FIG. 3), the first sheave 70 and the second sheave 74 are offset by a horizontal distance and are not directly in line with one another. In other embodiments, the rope-contacting elements are rollers, other elements that allow movement of the rope, or the like.

The spring-damper 82 is coupled between the arm 66 and the boom 18. In the illustrated embodiment, the spring-damper 82 includes a compression spring 110 and a dashpot 112. The compression spring 110 biases the arm 66 to pivot in a first direction 114, applying a pre-load on the rope 38 in a direction substantially perpendicular to the direction of travel 58 of the rope 38. The dashpot 112 resists the motion of the arm 66 in order to dampen the response behavior of the arm 66 as the rope tension changes. In other embodiments, other types of springs and spring-dampers are used, such as a rotary-type spring damper, utilizing, for example, a torsional spring and a rotary damper element.

FIGS. 2 and 3 illustrate the motion of the rope guide 30 during various rope tension conditions. When the rope 38 is slack, as shown in FIG. 2, the compression spring 110 biases the arm 66 and causes the arm 66 to rotate in the first direction 114 (counter clockwise as shown in FIG. 2). Rotation of the arm 66 effectively increases the length that the rope 38 must travel between the base 14 and the boom sheave 50. The first sheave 70 and the second sheave 74 remain in positive engagement with the rope 38, taking up the slack and maintaining a nominal tension in the rope 38. Referring to FIG. 3, as the rope 38 becomes taut, tension in the rope 38 increases and resists the biasing force of the compression spring 110. The arm 66 rotates against the spring 110 in a second direction 118 (clockwise as shown in FIG. 3).

Figure 4:
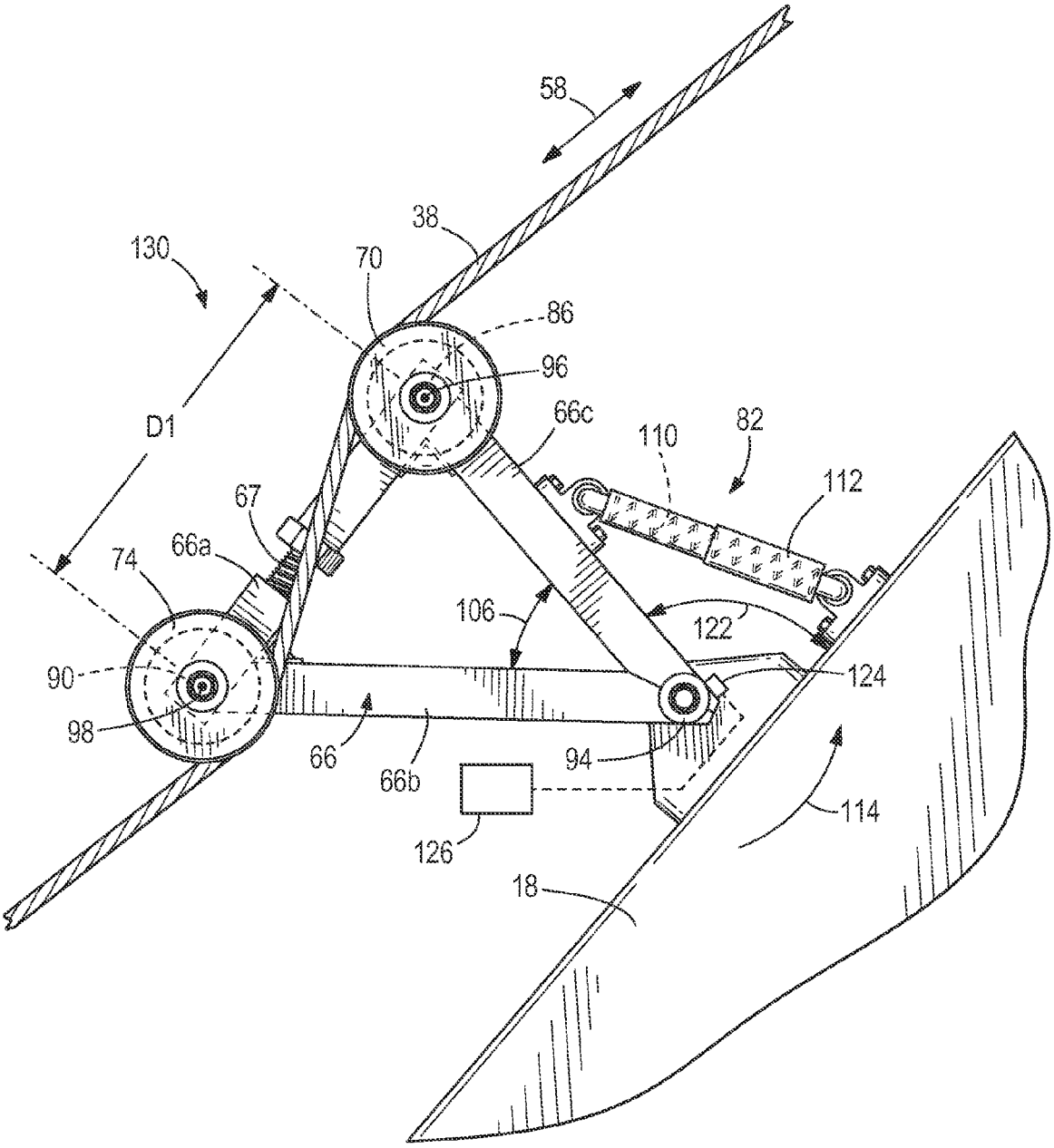
FIG. 4 is a side view of a rope guide according to another embodiment of the invention, with the hoist rope in a slack state.

FIG. 4 illustrates a rope guide 130 according to another embodiment of the invention. In the illustrated embodiment, the arm member 66*a* of the rope guide 130 is adjustable in length via an adjustment mechanism 67. The illustrated adjustment mechanism 67 is a screw element, though in further embodiments other structures are also possible, including use of pins, notches, and/or a plurality of telescoping segments. The adjustment mechanism 67 permits the distance D1 between sheaves 70, 74 to be altered, such that a pre-loaded tension within the rope 38 may be fine-tuned. For example, decreasing the length of arm member 66*a* creates higher pre-loaded tension in the rope 38. Alternatively, increasing the length of arm member 66*a* creates lower pre-loaded tension in the rope 38. Fine tuning of the distance D1 is used to reduce rope oscillations.

Figure 5:
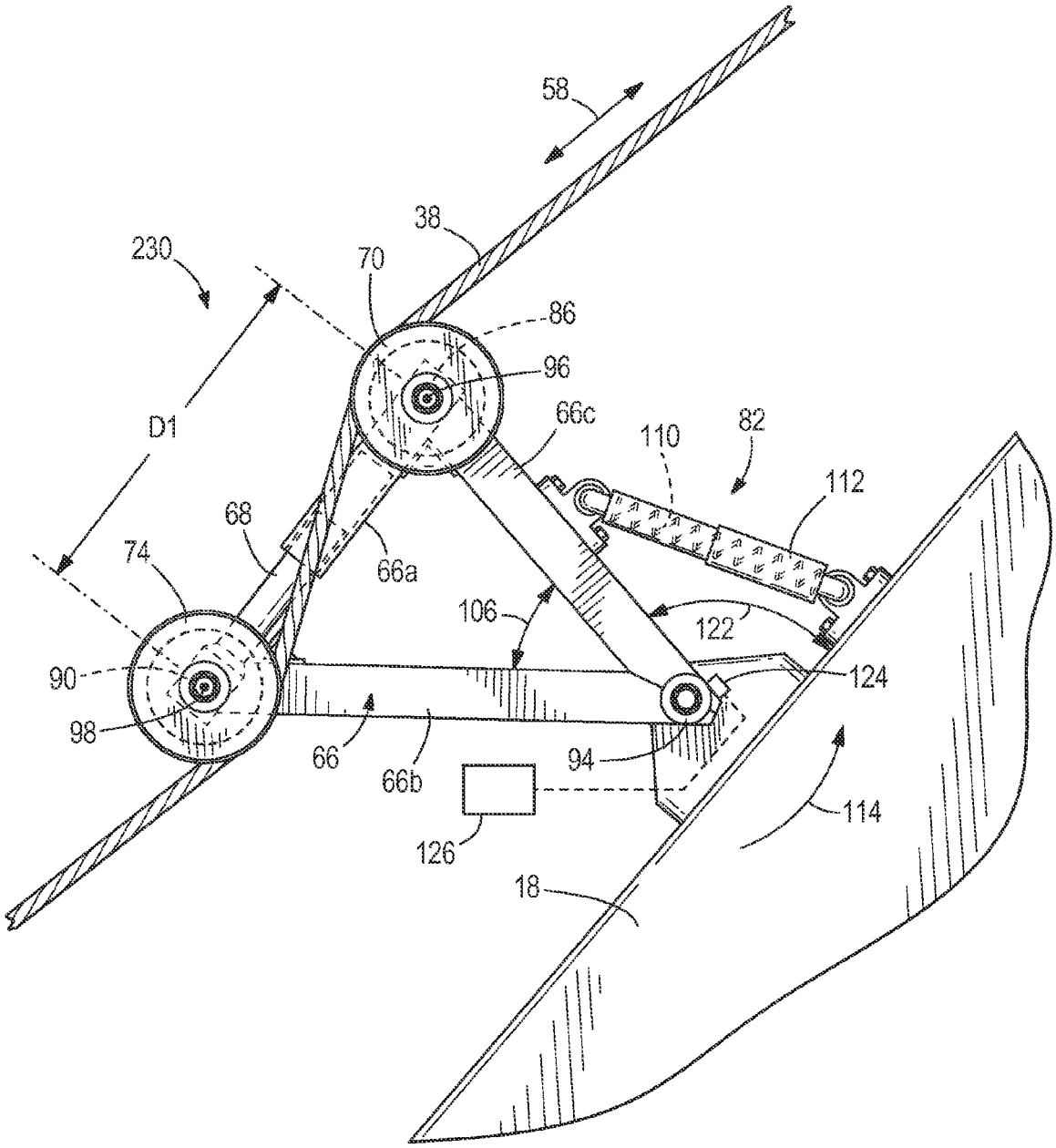
FIG. 5 is a side view of a rope guide according to another embodiment, with the hoist rope in a slack state.

FIG. 5 illustrates a rope guide 230 according to another embodiment of the invention. In the illustrated embodiment, the arm member 66*a* includes a vibration dampener 68. The vibration dampener 68 permits the length D1 between sheaves 70, 74 to vary in the presence of energy vibration. The vibration dampener 68 absorbs vibrational energy caused by the tension in the rope, and reduces rope oscillations.

Figure 6:
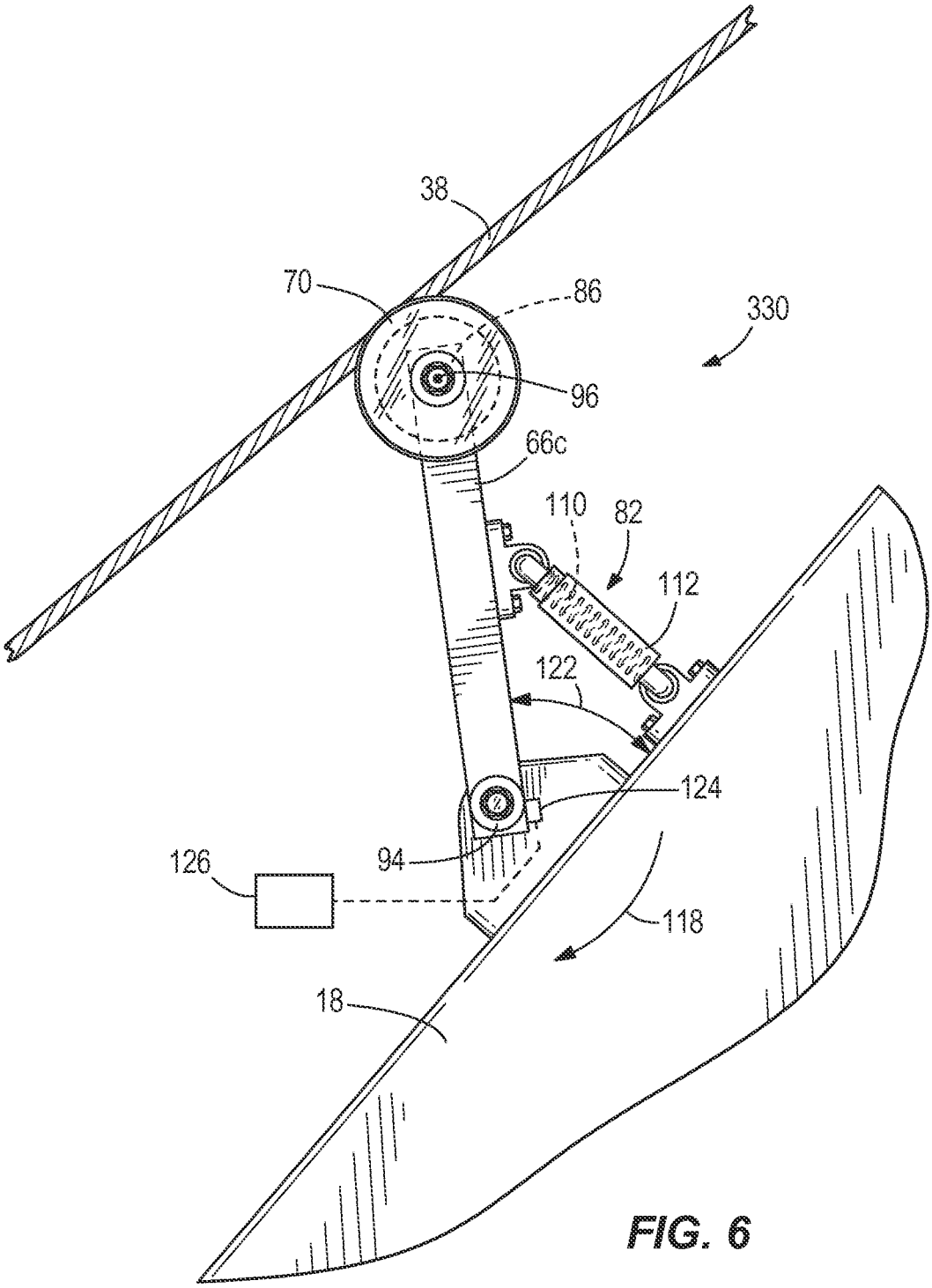
FIG. 6 is a side view of a rope guide according to another embodiment, with the hoist rope in a taut state.

FIG. 6 illustrates a rope guide 330 according to another embodiment of the invention that includes one sheave. Rotation of the sheave 70 increases the length of travel between the winch and the boom sheave 50, taking up slack in the hoist rope 38, and thereby reducing oscillations in the rope 38. The arm member 66*c* is longer than arm member 66*c* illustrated in the two-sheave configuration of FIGS. 2-3. With a longer arm member 66*c*, the single sheave configuration takes up as much slack in the rope 38 as the two-sheave configuration.

Figure 7:
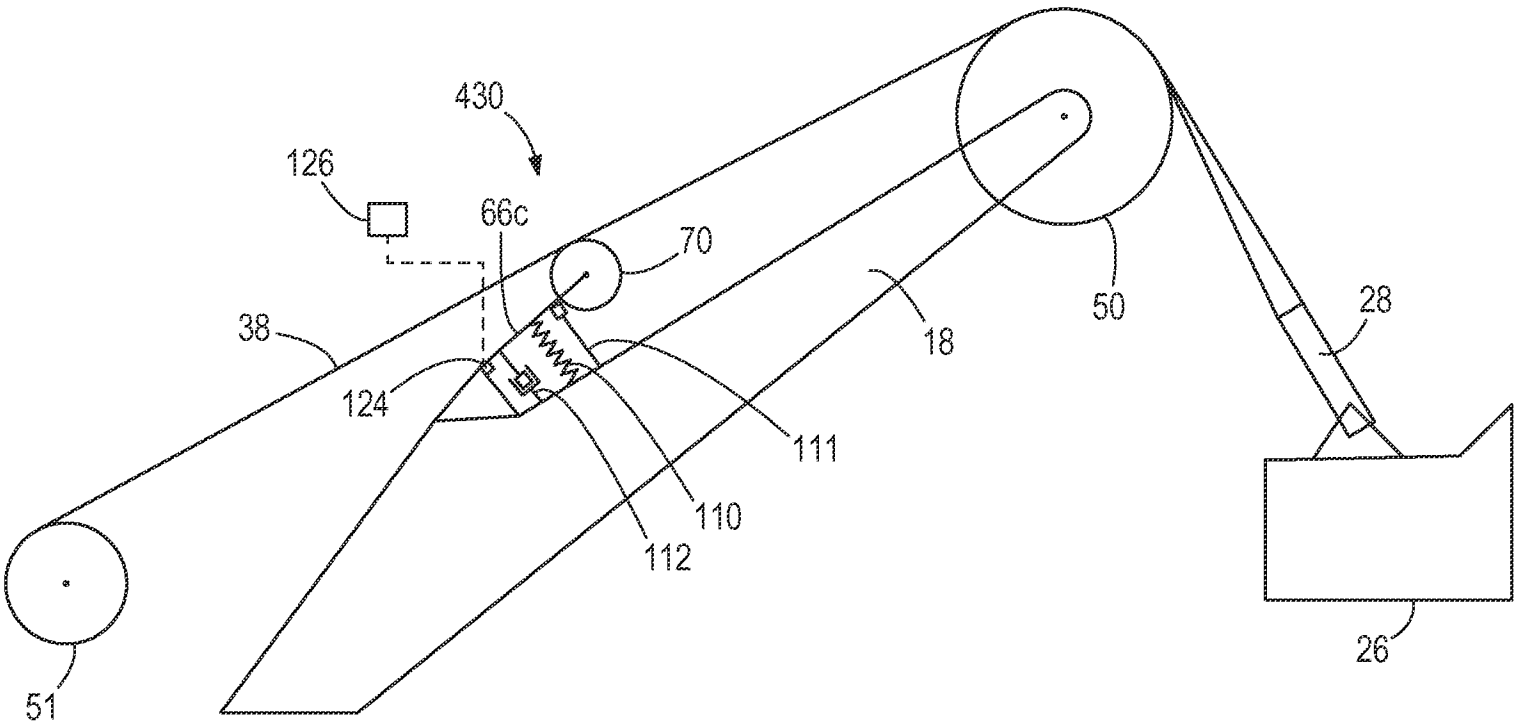
FIG. 7 is a schematic view of a mining shovel according to another embodiment, with the hoist rope in a taut state.

FIG. 7 is a schematic illustration of another embodiment of a mining shovel 110 that includes a rope guide 430 having a single sheave 70. The rope guide 430 is positioned approximately halfway between winch 51 and the boom sheave 50. The rope guides 30, 130, 230, and 330 illustrated in FIGS. 1-6 are also positioned approximately halfway between a winch and boom sheave 50, though other locations are also possible for the rope guides 30, 130, 230, 330, 430. FIG. 7 further illustrates a stabilizing arm 111. The stabilizing arm 111 is a rigid structure positioned along the boom 18, and prevents the arm member 66*c* from rotating past a predetermined angle.

In yet further embodiments, the rope guide 30 may be used in combination with a fleeting sheave rope guide, such as the type described in U.S. Pat. No. 7,024,806.

By providing positive engagement of the sheave(s) 70, 74 with the rope 38, the rope guides reduce slack in the rope 38, which in turn reduces the oscillation and wear on the rope 38, improving overall life of the rope 38 and the associated components. Furthermore, the rope guides provide a mechanism for determining the rope tension.

The rope guides are modeled as mass-spring-damper systems in which the rope tension provides an input force. For example, as illustrated in FIGS. 2-7, a sensor 124 is positioned near the arm 66. The sensor 124 detects an angle of rotation 122 of the arm 66 or arm member 66*c* with respect to the boom 18. The sensor 124 is in communication with a controller 126 (illustrated schematically in FIGS. 2-7). The sensor 124 sends a signal to the controller 126. By measuring the angle of rotation 122 with the sensor 124, it is possible for the controller 126 to calculate the angular velocity and angular acceleration of the arm 66 or arm member 66*c*. Applying principles of vibrational mechanics, these values can be used to calculate the force acting on the arm 66 or arm member 66*c*, which in turn provides the tension in the rope 38. In some embodiments, other characteristics of the rope guide 30 beside the angle of rotation 122 with respect to the boom 18 may be used to determine the rope tension. Based on the calculated rope tension, the controller 126 determines the available drive speed and torque that can be applied to the rope 38 via the winch 51 by an operator. For example, if the controller 126 determines that the rope tension is below a predetermined level (i.e. the rope is slack), the controller 126 reduces the available speed and torque to the rope that can be applied by the operator. In some embodiments, the available drive speed and torque applied to the rope can be reduced by as much as 90%, such that the operator can apply only up to 10% of the total drive speed and torque to the rope while the rope is slack. Other amounts of available drive speed and torque are also possible.

Figure 8:
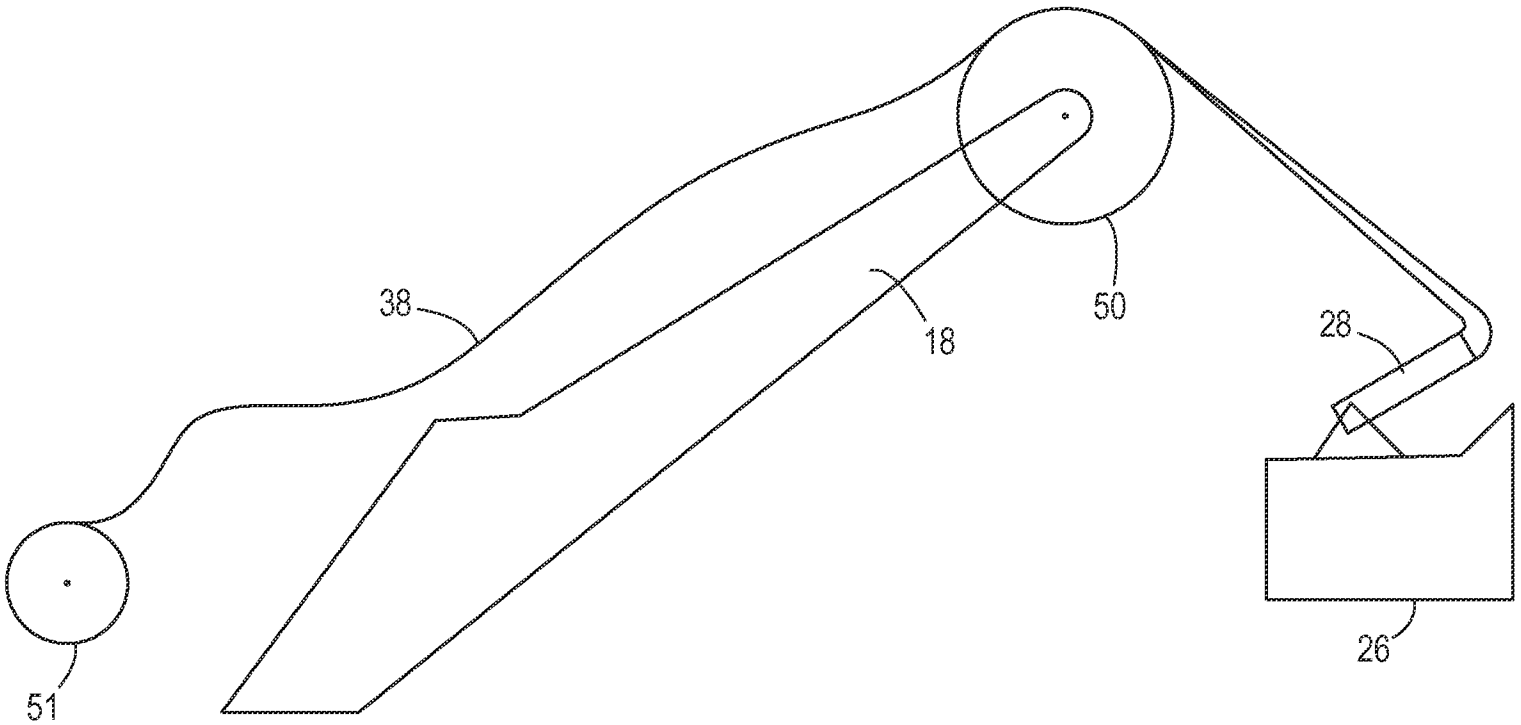
FIG. 8 is a schematic view of the mining shovel of FIG. 7, with the hoist rope in a slack state.

This type of control helps to inhibit high impact loading on the boom 18. For example, and with reference to FIGS. 7 and 8, if a rope 38 is slack (FIG. 8), rather than taut (FIG. 7), the boom 18 will tend to pivot and lie down. If the operator were to apply full speed and torque to the rope 38 via the winch 51 while the rope 38 was slack, this would impart a dynamic impact load (i.e. a "snapping" action of the rope and boom 18), which could potentially damage one or more components of the overall mining shovel 10. Incorporating a rope guide with sensor 124 and controller 126 helps to alleviate this potential problem.

Thus, the invention provides, among other things, a rope guide for a mining shovel. Although the invention has been described in detail with reference to certain preferred embodiments, variations and modifications exist within the scope and spirit of one or more independent aspects of the invention as described.

What is claimed is:

1. A system for controlling a rope on a mining shovel, the mining shovel including a boom, the boom including a first end and a second end, the rope passing between first end and the second end of the boom, the system comprising:

an arm coupled to the boom;

a rope-contacting element coupled to the arm;

a biasing member coupled to the rope-contacting element that biases the rope-contacting element into positive engagement with the rope; and a sensor positioned near the arm that detects movement of the arm caused by tension in the rope; and a controller coupled to the sensor that receives signals from the sensor.

2. The system of claim 1, wherein the arm is pivotally coupled to the boom.

3. The system of claim 1, wherein the arm has a triangular shape.

4. The system of claim 1, wherein the rope-contacting element is pivotally coupled to the arm.

5. The system of claim 1, wherein the rope-contacting element is a sheave.

6. The system of claim 1, wherein the rope-contacting element is a first rope-contacting element, and further comprising a second rope-contacting element coupled to the arm.

7. The rope guide of claim 6, wherein the arm includes a first end, a second end, and a third end, the first rope-contacting element coupled to the first end, and the second rope-contacting element coupled to the second end.

8. The rope guide of claim 7, wherein the third end is pivotably coupled to the boom.

9. The rope guide of claim 6, wherein the arm includes an adjustment mechanism for adjusting a distance between the first and second rope-contacting elements.

10. The rope guide of claim 6, wherein the arm includes a vibration dampener for adjusting a distance between the first and second rope-contacting elements.

11. The system of claim 1, wherein the biasing member is a spring damper having a compression spring.

12. The system of claim 1, wherein the biasing member biases the arm in a rotational direction.

13. The system of claim 1, wherein the sensor is configured to detect an angle of rotation of the arm with respect to the boom.

14. The system of claim 1, wherein the controller is configured to determine at least one of an available drive speed and torque of the rope based on the tension in the rope.

15. The system of claim 1, wherein the sensor is configured to communicate information regarding the angle of rotation to the controller, and wherein the controller is configured to calculate tension in the rope based on the angle of rotation of the arm.

16. The system of claim 1, further comprising a winch coupled to the rope that applies drive speed to the rope.

17. A system for controlling a rope on a mining shovel, the mining shovel including a boom, the boom including a first end and a second end, the rope passing between first end and the second end of the boom, the system comprising:

an arm pivotally coupled to the boom;

a rope-contacting element pivotally coupled to the arm;

a spring damper coupled between the boom and the arm that biases the arm to rotate in a rotational direction; and a sensor positioned near the arm that detects an angular rotation of the arm; and a controller coupled to the sensor that receives signals from the sensor.

18. The system of claim 17, wherein the controller is configured to receive a signal from the sensor relating to the angular rotation of the arm, to calculate a tension in the rope based on the angular rotation of the arm, and to determined an available drive speed and torque of the rope based on the calculated tension in the rope.

19. The system of claim 17, wherein the rope-contacting element is a first rope-contacting element, and further comprising a second rope-contacting element pivotally coupled to the arm.

20. The system of claim 17, wherein the arm has a triangular shape.

21. A system for controlling a rope on a mining shovel, the mining shovel including a boom, the boom including a first end and a second end, the rope passing between first end and the second end of the boom, the system comprising:

an arm coupled to the boom;

a rope-contacting element coupled to the arm;

a biasing member coupled to the rope-contacting element that biases the rope-contacting element into positive engagement with the rope; and a sensor positioned near the arm that detects movement of the arm caused by tension in the rope, wherein the sensor is configured to detect an angle of rotation of the arm with respect to the boom.

* * * * *